United States Patent [19]

Beers

[11] Patent Number: 5,071,085

[45] Date of Patent: Dec. 10, 1991

[54] QUICK CHANGE REEL FOR POWERED KITE LINE WINDER

[76] Inventor: Harry F. Beers, RR 3 Box 1051, Lewes, Del. 19958

[21] Appl. No.: 506,924

[22] Filed: Apr. 9, 1990

[51] Int. Cl.[5] ..... B65H 75/40; B65C 31/06

[52] U.S. Cl. ..... 242/96; 244/155 A

[58] Field of Search ..... 242/96, 250; 244/155 R, 244/155 A

[56] References Cited

U.S. PATENT DOCUMENTS

| | | | |
|---|---|---|---|
| 3,185,407 | 5/1965 | Lichtenstein | 242/96 |
| 3,202,378 | 8/1965 | Willimson | 242/96 X |
| 3,357,654 | 12/1967 | Losman et al. | 242/96 |
| 3,593,940 | 7/1971 | Stanton | 242/96 |
| 3,784,125 | 1/1974 | Law et al. | 242/96 |
| 3,822,839 | 7/1974 | Persichini | 242/96 |
| 4,717,086 | 1/1988 | Crow | 242/96 X |
| 4,796,827 | 1/1989 | Munt et al. | 242/96 |
| 4,915,320 | 4/1990 | Neal | 242/96 |

*Primary Examiner*—John M. Jillions

[57] ABSTRACT

A quick change reel for powered kite line winders is disclosed which is ideally suited for the kite flyer who wants to have spare prewound reels on hand. The reel is easily detached by pivoting a bracket on the handle to allow sufficient clearance to remove the reel. The motor assembly and handle are attached to another bracket and extend perpendicularly from that bracket. The handle has a reversing switch for controlling rotation of the motor to wind and unwind the line.

1 Claim, 1 Drawing Sheet

QUICK CHANGE REEL FOR POWERED KITE LINE WINDER

FIELD OF THE INVENTION

The present invention relates to power driven kite string reels. In particular, the present invention relates to providing a means for detaching and replacing a reel in several seconds.

BACKGROUND OF THE INVENTION

Previous power driven kite reels were cumbersome to use. The design of both U.S. Pat. No. 3,593,940 and U.S. Pat. No. 3,822,839 are such that the reels can not be detached. Changing a kite line is cumbersome and time consuming. The line before it can be removed must be completely unwound before a replacement line can be attached. Then the line must be wound onto the reel before launching the kite.

The problem associated with kite flying is kite line management before, during, and after flight. Kite line requirements vary from plain cord string to over 100 lb test line depending on the size and type of the kite. What is needed is a device which provides a means for quickly changing reels. Spare prewound reels could be kept available at all times, each having the desired type of line. Then the mounted reel could be easily detached and replaced with one of the spare reels in several seconds.

SUMMARY OF THE INVENTION

It is an object of the present invention to provide a means for quickly detaching and replacing a reel in several seconds.

It is a further object of this invention to provide a kite line system that has relatively few moving parts.

DETAILED DESCRIPTION OF THE INVENTION

Figure 1:
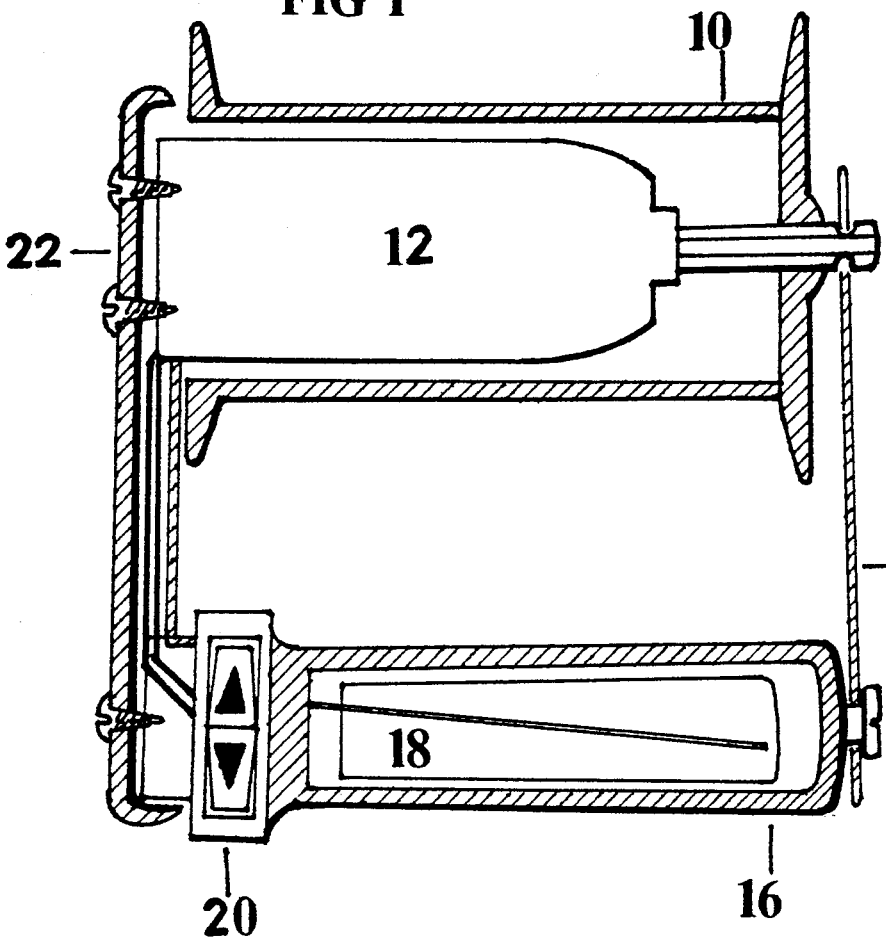
FIG. 1 is a partial cross-sectional view of the first embodiment of the invention.
Figure 3:
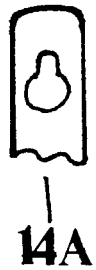
FIG. 3 is a partial side view of the bracket 14 of FIG. 1.

Referring to FIG. 1 the first embodiment of the invention includes a bracket 22 for mounting a handle and a motor assembly. The handle 16 extends perpendicularly from one side of the bracket for manually holding the powered kite line winder. Inside of the handle is accommodated the powerpack 18 for powering the motor 12 which is operated by a switch 20. The motor 12 is mounted to the same side of the bracket 22 and extends substantially parallel to the handle 16. The motor 12 includes a drive shaft which is in driving engagement with a hollow reel 10. The reel 10 is accommodated over and encloses the motor 12 and includes a drive connection to the motor drive shaft. The winder further includes a bracket 14 pivotally mounted at one end thereof to the free end of handle 16. The other end 14A of the bracket 14 includes a keyhole type slot for removably attaching the end 14A of the bracket 14 to the motor drive shaft.

The reel 10 can be easily and quickly removed or replaced by simply slipping the end 14A of the bracket 14 off of the end of the drive shaft, pivoting the bracket 14 and removing the reel from its engagement with the drive shaft.

Figure 2:
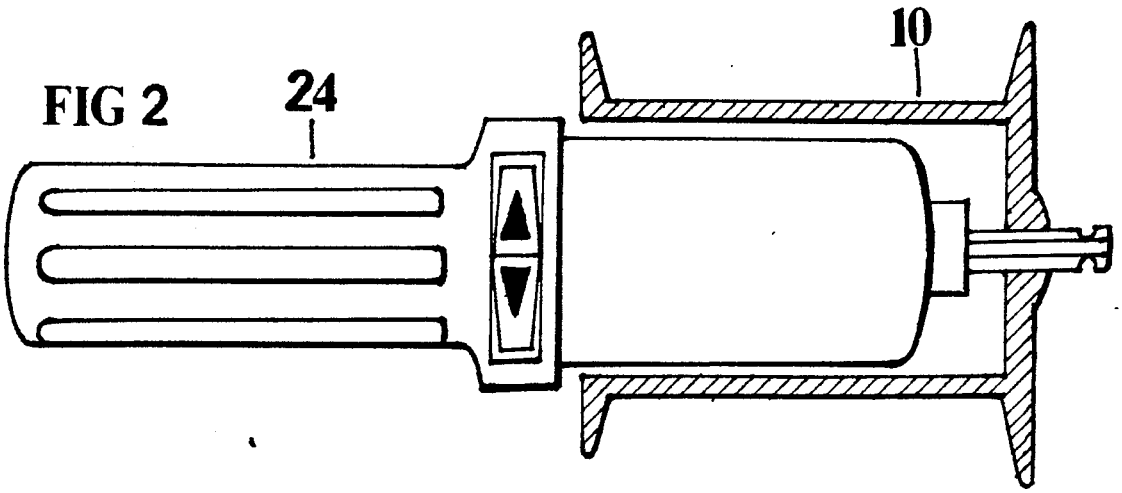
FIG. 2 is a partial cross-sectional view of a second embodiment of the invention.

FIG. 2 shows an alternate embodiment of the invention wherein the reel 10, of the same configuration as depicted in FIG. 1, can be placed over the end of a power tool 24. One side of the reel 10 has a driving connection to the drive shaft of the power tool.

I claim:

1. A portable powered kite line winder assembly comprising: a bracket, an elongated handle extending from the bracket for manually supporting the assembly, a motor connected to and extending from the bracket substantially parallel to the handle, said motor including a drive shaft extending from the unconnected end of the motor, a hollow reel accomodated over and enclosing the motor and having means for drivingly connecting the reel to the drive shaft, and a second bracket pivotal at one end thereof on the end of said handle and having means at the other end thereof for removably attaching the second bracket to the drive shaft, whereby when the second bracket is removed from the drive shaft and pivoted on the handle the reel may be quickly detached from the drive shaft.

* * * * *